US005197783A

United States Patent [19]

Theimer et al.

[11] Patent Number: 5,197,783

[45] Date of Patent: Mar. 30, 1993

[54] EXTENDABLE/ERECTABLE ARM ASSEMBLY AND METHOD OF BOREHOLE MINING

[75] Inventors: Kenneth J. Theimer, Auburn; Michael McDonald, Summer; Gerald S. Knoke, Kent, all of Wash.; Raj Paul, Calgary, Canada

[73] Assignee: ESSO Resources Canada Ltd., Alberta, Canada

[21] Appl. No.: 692,864

[22] Filed: Apr. 29, 1991

[51] Int. Cl.[5] ..... E21B 7/08; E21C 25/60

[52] U.S. Cl. ..... 299/17; 175/67; 175/77; 175/79

[58] Field of Search ..... 299/16, 17; 175/77, 175/78, 79, 80, 81, 67, 82

[56] References Cited

U.S. PATENT DOCUMENTS

| | | | |
|---|---|---|---|
| 449,459 | 3/1891 | Addison . | |
| 1,367,042 | 2/1921 | Granville . | |
| 1,424,109 | 7/1922 | McBride . | |
| 2,251,916 | 8/1941 | Cross | 175/79 X |
| 2,258,001 | 10/1941 | Chamberlain | 175/40 |
| 2,516,421 | 7/1950 | Robertson | 175/78 |
| 3,191,697 | 6/1965 | Haines | 175/81 |
| 4,007,797 | 2/1977 | Jeter | 175/26 |
| 4,051,908 | 10/1977 | Driver | 175/78 |
| 4,168,752 | 9/1979 | Sabol | 175/77 X |
| 4,401,345 | 8/1983 | Archibald | 299/17 X |
| 4,437,706 | 3/1984 | Johnson | 299/7 |
| 4,444,276 | 4/1984 | Peterson, Jr. | 175/61 |
| 4,497,381 | 2/1985 | Dickinson, III et al. | 175/77 X |
| 4,577,703 | 3/1986 | Cyriacy et al. | 175/79 |
| 4,640,362 | 2/1987 | Schellstede | 166/298 |
| 4,658,916 | 4/1987 | Bond | 175/81 |
| 4,674,579 | 6/1987 | Geller et al. | 175/45 |

OTHER PUBLICATIONS

Scott, L. E., "Borehole Mining of Phosphate Ores", Flow Technology Company, Flow Technology Report No. 199 (1981).

*Primary Examiner*—David J. Bagnell

*Attorney, Agent, or Firm*—Seidel, Gonda, Lavorgna & Monaco

[57] ABSTRACT

An extendable, retractable, erectable arm assembly for housing and supporting a water conduit extending outward from a tool located in a borehole, to a nozzle to produce a high pressure water cutting jet is provided. The arm assembly includes a plurality of interlocking arm segments for housing, supporting and moving the conduit through an angle of about 90° from a stowed position to an operating position. The arm segments include integral, separable hinges capable of being interlocked such that pivotable movement is possible along any side thereof. These segments have mating apertures therethrough to accommodate the conduit. The assembly also includes an erecting device which provides compression on the segments and which gives the arm rigidity during movements. An alignment device is also included which keeps the segments aligned when the arm is deflected. There is also a device which applies tension to the erecting device; thus, allowing the nozzle to remain in close proximity to a surface at which the cutting jet is directed. The assembly also has a launching device designed to turn and lift the arm so that it may be extended and retracted at any angle and position. There is also a device which moves the arm within the tool along the longitudinal axis of the hole. The aforementioned assembly may be incorporated into borehole mining apparatuses and used in borehole mining processes.

30 Claims, 7 Drawing Sheets

4B
54
4B 4
33
34
48
43a
43b
43
44
40
41
4
45
20
41a
41b
41c
49
55
50
51
52
26
45
47
30
31
53
25
24
4A
4A
4

EXTENDABLE/ERECTABLE ARM ASSEMBLY AND METHOD OF BOREHOLE MINING

TECHNICAL FIELD OF THE INVENTION

This invention relates to an extendable, retractable, erectable arm assembly which may be used in the drilling of unconsolidated materials, such as soil with the use of a high pressure fluid. While the assembly has application for drilling and exploring underground passageways for utilities, it has particular use in the extraction of minerals, or mineral bearing ore, such as bitumen from subterranean deposits, such as tar sands. Thus the invention provides for the arm assembly in combination with a borehole mining tool, which arm assembly holds a water jet nozzle close to a surface of a cavity wall being mined and formed. The invention permits a substantial increase in the size of the cavity that can be mined, and further, the arm assembly permits the mining to occur in an air filled cavity or in a water filled cavity. In the latter case, the arm assembly is operational when fully submerged in water.

BACKGROUND OF THE INVENTION

Borehole mining is a technique for extracting minerals from sub-terranean deposits through a borehole with minimal disturbance to the surface. A mining tool containing a water supply conduit and a water jet nozzle, and a slurry pump is lowered down through a borehole to the deposit. The water jet (cutting jet) produced by delivering water under high pressure to the nozzle is used to cut or erode the mineral bearing ore and to create a slurry. The slurry is pumped by the downhole slurry pump to the surface for mineral extraction. As the ore is removed from the borehole, a cavity is created underground. When the mining is complete, the tailings from the extraction process are pumped back into the cavity to reduce the disturbance to the formation surrounding the cavity.

Borehole mining is used to extract a wide variety of minerals such as coal in general, including lignite, uranium, phosphate, gold, kaolin or any other minerals which are found in soft rock formations. The technique works best where a high pressure water jet may be used to cut rocks.

Only a fraction of Canada's extensive tar sand deposits can be extracted using current technology. Shallow tar sands deposits are generally removed by open pit mining techniques. In deep deposits, bitumen can be extracted from tar sands by mining tar sands with conventional tunnel mining techniques or by injecting steam into the tar sands formation and recovering a liquified bitumen from wells by pumping. Between the shallow and deep formation lie enormous reserves of bitumen-laden tar sands, but these cannot be economically extracted by the conventional techniques.

Tar sands are a mixture of sands, clays, water and bitumen; where the sand particles are surrounded by a water film in the sands, clays and bitumen fabric. In the borehole mining technique, the water jet loosens the sand particles from the tar sands fabric and frees the bitumen from the sands. Being nearly naturally buoyant and having nearly the same specific gravity as water, the freed bitumen goes into suspension in the water medium in the cavity. As the clean sand falls to the bottom of the cavity, most of the bitumen attaches itself to air bubbles and rises to the surface in the cavity as froth, whereas a fraction of bitumen that is still attached to the sands falls to the bottom of the cavity and may be lost in the sand.

Ideally, the cutting jet will separate each particle of sand from its neighbours and frees the bitumen. In practice, however, the tar sands deposit will be cut by the water jet and broken into chunks of various sizes, from single particles to large clumps. These clumps then require further cutting action by the water jet to free the bitumen. The most efficient mining technique will be the one that breaks up the tar sands most completely in a single operation.

In the normal borehole mining technique, most of the jetted water in the cavity was removed leaving an air-filled cavity. This was done to give the water jet maximum effective cutting range. However, the air-filled cavity has two major disadvantages. First, the slurry must be pumped under substantial pressure to lift it from the cavity horizon to the surface. The power required for the downhole pump increases as the depth of the deposit increases. At some depth, it is no longer practical or economical to pump the slurry as either the pump size becomes enormously large or a number of pumping stages may have to be applied. Second, when the ore deposit does not have sufficient strength to support the walls of the cavity, subsidence results. Subsidence interferes with the mining process by blocking the slurry pump inlet with large chunks, diluting the ore with overburden and possibly collapsing the cavity.

One way of reducing the downhole pumping requirements and the tendency for the ore to subside, is to fill the cavity to the surface with water, thus providing hydraulic pressure to support the cavity walls. The major drawback of this approach has been the reduction of the water jet's effective cutting range when operating submerged. Traditionally, the water jet nozzle is located on the mining tool which must fit down through the borehole. As the cavity size increases during the mining process, the cavity wall being cut recedes farther from the cutting jet nozzle. Eventually, the jet can no longer reach the cavity wall with enough cutting force to create the slurry. In an air-filled cavity, this distance is on the order of 1,000 times the nozzle diameter. Under water, this distance is reduced to approximately 100 times the nozzle diameter for the same cutting pressure (depending on the ore being mined and the pressure inside of the nozzle). This is a major impediment to the success of borehole mining since the size of the cavity created and therefore the amount of ore removed from the cavity is reduced substantially. This renders the technique uneconomic. To make the system economic, the cavity diameter needs to be maximized.

Previous efforts have been made to extend the range of the submerged water jet by shrouding the jet with an air shield (Flow Technology Report No. 199, August, 1981). This increased the effective range of the jet somewhat but added the complexity and power requirements of a high pressure air compressor. Another technique considered for extending the range of the jet is to simply increase the nozzle size and water flow rate. However, a modest increase in effective range is offset by a substantial increase in required pump horsepower and tool size. Finally, increased cutting jet nozzle pressure does not significantly extend the range of the jet under water.

The prior art describes a variety of extendable/erectable semi-flexible drill stems. In U.S. Pat. No. 4,437,706 issued Mar. 20, 1984 to Gulf Canada Ltd. (Johnson), there is described an apparatus for hydraulic mining of tar sands which includes a cutting nozzle, means for moving the nozzle towards the face as it erodes and recovering means for the separated material. The manner in which the jet is advanced toward the face involves a plurality of jets, with the forward component for the nozzle being at least one jet having a forward angle.

U.S. Pat. No. 2,258,001 to L. C. Chamberlain issued Oct. 7, 1941 shows an apparatus for drilling wells which includes a flexible housing conduit to which is attached a nozzle in the form of a jet. The flexible conduit is formed of spiral metal ribbon.

U.S. Pat. No. 4,007,797 issued Feb. 15, 1977 to Jeter describes a device which includes a housing that can be moved through a borehole and anchored in a desired location for drilling a lateral hole. The housing includes a drill string guide or conductor having a bendable lower end. The drill string and conductor can be retracted into the housing when the lateral hole has been drilled, or a portion of the drill string may be left in the lateral hole as a drain pipe. In the drawings, there can be seen portions of a bendable conductor which included individual links arranged in chain fashion, with each link being hingedly connected to the adjacent link so that each link may pivot relative to the adjacent link about a hinge pin centreline or axis. A flexible tension member urges the link to curve above the hinge pin axis.

U.S. Pat. No. 4,444,276 issued Apr. 24, 1984 to Peterson, Jr. shows a network of flexible tubes or pipes connected to a drill pipe which tubes or pipes are spring biased to flare outwardly such that fluid may be pumped and directed to underground formations.

U.S. Pat. No. 449,459 issued Mar. 31, 1891 to Addison describes a groove cutting machine for oil or gas wells. The structure includes a flexible chain which is adapted to be forced out through an aperture in the side of the casing. At the free or outer end of the claim is a cutting implement. The flexible chain comprises a series of central links, each having a transverse tongue at one end and a transverse groove at the other. Shoulders are cut away upon the front or upper sides of the tongue to permit the chain to bend in an upward or forward position.

U.S. Pat. No. 1,367,042 issued Feb. 1, 1921 to Granville discloses a drilling apparatus which includes a flexible pipe and flexible drive shaft such that holes are drilled at right angles from a well. The flexible drive shaft consisting of a set of links whose connections form a series of universal joints is disclosed. Sucker rods are attached to one end and a drill is attached to the other end of the pipe. Water is fed into the shaft and that pressure drives the drill forward. The drill assembly is pulled back up by exerting a pull on the sucker rods.

U.S. Pat. No. 1,424,109 issued Jul. 25, 1922 to McBride describes a bendable drilling device for horizontal drilling which includes a hollow flexible shaft carrying a bit which shaft carries a flexible hose for conducting water to the bit.

U.S. Pat. No. 2,516,421 issued Jul. 25, 1950 to Robertson discloses a flexible shaft which permits lateral drilling. Means are provided to advance and retract the flexible shaft and a drill head attached thereto.

U.S. Pat. No. 3,191,697 issued Jun. 29, 1965 to Haines discloses another tool for horizontal or lateral drilling which may be extended or retracted.

U S. Pat. No. 4,051,908 issued Oct. 4, 1977 to Driver discloses another system for horizontal drilling.

U.S. Pat. No. 4,577,703 issued Mar. 25, 1986 to Cyriacy et al discloses yet another system for lateral drilling which includes a flexible drilling shaft formed by a steel spiral. A pressure hose extends within the shaft to feed fluid for drilling.

U.S. Pat. No. 4,640,362 issued Feb. 3, 1987 to Schellstede and U.S. Pat. No. 4,658,916 issued Apr. 21, 1987 to Bond describe other lateral drilling system.

Once again there is seen in U.S. Pat. No. 4,658,916 issued Apr. 21, 1987 to Bond a system for drilling lateral holes. Concentric, counterwound spring shafts operating in conjunction with a rotary drive source and a guide housing to direct the rotating, bendable shaft down and outward in a radial direction.

In U.S. Pat. No. 4,674,579 issued Jun. 23, 1987 to Geller et al, there is disclosed on apparatus and method including an offset head fluid drilling and reaming apparatus wherein the drill is maneuverable and has means for remote sensing of orientation and depth. The apparatus is used for drilling unconsolidated material by the use of jet cutting techniques therethrough. Electronic guidance means permits the formation of a hole in a predetermined path or to follow an existing utility line.

SUMMARY OF THE INVENTION

The present invention provides an extendable, retractable, erectable arm assembly for housing and supporting a water conduit which extends outward from a tool located in a borehole, to a nozzle to produce a high pressure water cutting jet, said arm assembly comprising a plurality of interlocking arm segments for housing, supporting and moving the conduit through an angle of about 90 from a stowed position to an operating position; said arm segments comprising integral, separable hinges having interlocking means such that pivotal movement is possible along any side thereof, and having mating apertures therethrough to accommodate the conduit; erecting means at an upper portion of the arm segments to provide compression on the segments giving the arm rigidity during movement in any direction; alignment means at a lower portion of the arm segments to keep the arm segments aligned when the arm is deflected; means for applying tension to the erecting means whereby the arm may be held erect in a cantilever position allowing the nozzle to remain in close proximity to a surface at which the high pressure water cutting jet is directed; launching means to turn and lift the arm so that the arm may be extended and retracted at any angle and position; and means for moving the arm within the tool from one position to another along the longitudinal axis of the borehole whereby the arm is extended and retracted and hence travels from operating to stowed positions.

In another aspect, the invention provides an apparatus for borehole mining comprising a) a mining rig for location on a surface at a collar of a borehole drilled for mining purposes, which incorporates a mining tool, a pressurized water source for the tool, and means for rotating the mining tool about its central axis.

b) the mining tool comprising an extendable, retractable, erectable arm assembly for housing and supporting a water conduit which extends outward from a tool located in a borehole, to a nozzle to produce a high pressure water cutting jet, said arm assembly comprising a plurality of interlocking arm segments for housing, supporting and moving the conduit through an angle of about 90° from a stowed position to an operating position; said arm segments comprising integral, separable hinges having interlocking means such that pivotal movement is possible along any side thereof, and having mating apertures therethrough to accommodate the conduit; erecting means at an upper portion of the arm segments to provide compression on the segments giving the arm rigidity during movement in any direction; alignment means at a lower portion of the arm segments to keep the arm segments aligned when the arm is deflected; means for applying tension to the erecting means whereby the arm may be held erect in a cantilever position allowing the nozzle to remain in close proximity to a surface at which the high pressure water cutting jet is directed; launching means to turn and lift the arm so that the arm may be extended and retracted at any angle and position; and means for moving the arm within the tool from one position to another along the longitudinal axis of the borehole whereby the arm is extended and retracted and hence travels from operating to stowed positions.

c) a slurry pump associated with the mining tool for pumping mined slurry to the surface;

d) remote operating means at the surface for the mining tool for rotating the tool, applying tension to the arm, retracting, extending and erecting the arm, and mining the ore;

e) cavity sensing means located in the mining tool for sending information to the surface about the size, shape or nature of the cavity; and f) water supply means for flooding the mining cavity with water whereby the cutting jet operates submerged under water.

In a broader aspect, the invention provides a method of borehole mining subterranean ore deposits which comprises the following steps:

a) placing a mining rig on a surface at a collar of a borehole drilled for mining purposes, which rig includes a mining tool, a pressurized water source for the tool and means for rotating the mining tool about its central axis, b) inserting the mining tool and a slurry pump from the rig into the borehole and lowering the tool to the ore zone, c) reducing the ore to a slurry by the action of a water cutting jet of the mining tool which is directed horizontally at the side of the borehole, d) supporting the cutting jet for semi-flexible movement in all horizontal and vertical directions as it extends and retracts and bends from, to and through a generally vertical, stowed position to a generally horizontal mining position and supporting the jet to ensure that cutting action continues and the jet remains in close proximity with the retreating mining face, and rotating the cutting jet about the mining tool axis and raising and lowering its position relative to the surface, such that a mining cavity is formed, e) remotely controlling and positioning the cutting jet for mining action, f) removing the water from the cutting jet from the cavity such that the cutting jet operates in air or permitting the water from the cutting jet to remain in the cavity such that the cutting jet operates submerged in water, and g) removing the slurry from the cavity.

BRIEF DESCRIPTION OF THE DRAWINGS

Referring now to the drawings which are used to illustrate the present invention, like reference numerals are used throughout to identify the same parts.

DETAILED DESCRIPTION OF INVENTION

Figure 1:
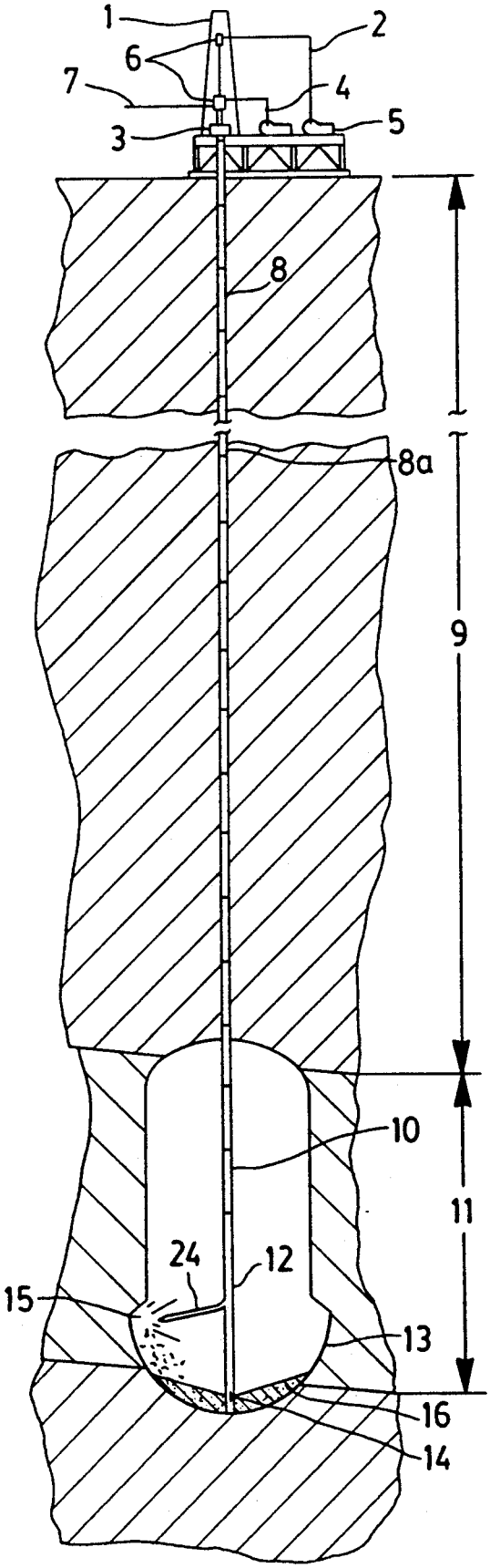
FIG. 1 is a cross section of a borehole mine assembly in which the present invention may be utilized.

The design of the arm assembly of this invention is such that the cutting jet may operate in air or under water. In the latter instance, a separate water supply may be provided to the cavity, which is kept filled during operation. The slurry recovery which is normally accomplished through the use of a slurry pump is run at a faster rate than the rate at which water is supplied to the cavity via the cutting jet nozzle.

The mineral to be mined is preferably bitumen and the ore is tar sands, but other minerals which are found in soft rock formations and may be mined with a water cutting jet may be recovered with this apparatus and method. As stated previously, these minerals may be coal, including lignite, uranium, phosphate, gold, kaolin or any other minerals found in soft rock formations.

The apparatuses of this invention may also be used in other areas than mining, such as in sewer and utility maintenance and excavation.

This invention overcomes the problem of reduced water jet effectiveness under water by keeping a jet cutting nozzle close to an ore face being mined. This is accomplished by extending the nozzle out from the mining tool as the mining progresses. In the apparatus of this invention, a semi-flexible, extendable and erectable arm supports the water jet nozzle at some distance away from the mining tool housing. The arm can be extended or retracted and raised or lowered remotely by the operator on the mining rig. The distance from the mining tool to the cavity wall is measured by a cavity size sensing system located in the mining tool. The operator on the surface uses this distance information to determine the correct extension and angle of the arm. The sensing system may consist of either a ground penetrating radar or low frequency sonar transducer located within the mining tool. Such systems are those which are conventionally available for such purposes.

The extendable arm is preferably comprised of interlocking segments with holes through the interior of each segment for the passage of the high pressure water jet supply hose and four cables. The preferred configuration of the arm is square in cross section, however, it could be some other rectangular, elliptical or circular shape. The length of each segment may be equal to or less than the height of the segment. Preferably, a pair each of tensioning and alignment cables is arranged with the tension cables in each top corner of the arm segments. The water jet supply hose preferably passes through the center of the segments. The upper tensioning cables are terminated at the nozzle end of the articulated arm with cable end fittings swaged onto the cables. The lower alignment cables are terminated in a similar manner at the nozzle end of the arm. Tension on the upper cables is reacted by compression on the segments thereby holding the interlocking arm segments together giving the arm its rigidity. By locating the tension cables near the top of the arm, they have maximum effect against gravity which tends to pull the arm downward. The lower alignment cables are required only to keep the segments properly aligned when the arm is deflected. These cables ensure that the segments are properly aligned for mating after they have been separated during bending. The points of contact between the interlocking segments are preferably hardened male and female hinge joints. The hinge joints are arranged on each of the four edges of the mating faces of each segment. The male portion of the hinge is preferably of semi-cylindrical shape, with a mating female semi-cylindrical intrusion on the mating face of the adjacent segment. The location of these hinge joints allows arm flexibility in both vertical and horizontal directions. The tension cable apertures in the arm segments are designed such that bending of the arm from vertical (stowed) to horizontal (mining) and back again as accomplished by a launching means, described below, or other bending motion imposed by operation of the device is achieved without abrupt bends in the tension cables which might damage the cables.

The arm assembly can extend and retract horizontally out of the vertical mining tool and hence it must turn from horizontal to vertical at some point along its length. The launching means, serves to turn the arm as it exits the mining tool housing. The launching means preferably includes upper and lower guide means. Preferably the upper guide means comprises guide rollers along the upper edge of the path of travel of the arm as it traverses the launching mechanism. These rollers reduce friction at the upper edge of the path, while the lower guide means preferably comprises a smooth guide chain at the lower edge of the path. When the segmented arm is extended out more or less horizontally from the vertical mining tool, the segments are hinged open on the underside of the arm as it passes through the elbow forming an irregular surface unsuitable for rollers. The chain provides a smooth curved path of varying radius on the lower side of the segmented arm as it moves through this area.

A tension frame or cable tensioning frame may be provided to apply tension to the tensioning cables and alignment cables of the extendable/erectable arm as necessary to hold the arm erect or rigid. The frame is located at the upper or inboard end of the arm inside of the mining tool housing. Inside of the tensioning frame may be two hydraulic tensioning cylinders, one for each upper tension cable. One cylinder could be used. The cables may pass over angled sheaves to provide compact and convenient locations for the tensioning cylinders. The tension on the upper cables holds the arm tight against the bottom of the tensioning frame. The arm may be conveniently extended and retracted through the launching mechanism by raising and lowering the tensioning frame in the passage along the center of the mining tool housing. The tensioning frame may be raised and lowered by the attached high pressure water jet supply conduit or pipe which extends to the mining rig at the surface. The lower alignment cables are attached to tensioning springs in the tension frame which maintain a minimal tension on the cables so that they can adjust to the changing length of their path as the elbow is raised and lowered or when the arm is bent outside of the mining tool.

The arm can be extended out from the mining tool a distance at least 50 times the height of the arm segments at angles approximately 90° to the axis of the borehole and it can be extended at least 100 times or more the height of the arm segments and at angles approaching 0° (vertical).

Referring now to the drawings, in FIG. 1 there is illustrated the major elements of a borehole mining system. A borehole 8*a* is drilled through overburden 9, with a mining rig 1 located on the surface above the ore zone 11. The mining rig 1 includes high pressure water pumps 5, jet pump supply hose 4, cutting jet supply hose 2, swivels 6, slurry discharge outlet 7 and a rotary drive 3. A casing 8 is installed to the top of ore zone 11 and the mining tool 12 is inserted into the borehole 8*a* by the mining rig 1 at the surface. By attaching multiple standard sections 10 to the top of the mining tool 12, the mining tool 12 is lowered down to the top of the ore zone 11. These standard sections 10 are tubular pieces which connect the swivel 6 to the mining tool 12. These sections 10 while not illustrated have multiple passages through them to conduct the mined slurry, hydraulic fluids and the jet pump high pressure water between the surface and the downhole mining tool 12. They also contain passages for electrical conductors and the high pressure cutting jet supply conduit or pipe 4. These sections 10 are bolted together, in series with seals between. The ore is reduced to a slurry 16 by the action of the water jet 15, which is also called a cutting jet, which is directed more or less horizontally at the side of the borehole. The water jet 15 is rotated slowly about the axis of the mining tool 12 using a rotary drive 3 on the mining rig. Swivels 6 and hoses 2 and 4 connect the rotating standard sections 10 to the stationary rig high pressure water pumps 5. The ore slurry 16 is removed from the bottom of the borehole cavity by the downhole slurry pump (not illustrated) located inside the mining tool 12 via the downhole slurry pump inlet 14 which is an integral part of the downhole slurry pump. As the elevation of the water jet 15 and cutting nozzle is slowly changed, a more or less cylindrical borehole cavity 13 is created. Reference should also be made to FIGS. 6A to 6F inclusive which illustrate six steps in a typical mining sequence.

There is no drawing of a downhole pump which is used in the mining assembly of this invention. The preferred type of downhole pump used for borehole mining with a water filled cavity is the eductor jet pump.

This pump has no moving parts and handles slurries without difficulty.

The jet pump is not unique to this invention but is described here due to its close relationship with the invention. In an air filled cavity, the effectiveness of the jet pump is limited by the depth of borehole cavity. In a water filled cavity, the slurry pump is required only to offset the difference in density between the slurry and the surrounding water and to overcome friction losses in the slurry passage. The jet pump works by directing a high pressure water jet from a nozzle upwards through a diffuser tube (eductor) which is open on the bottom and connected to a slurry pipe at the top. Water and solids are drawn into the open end of diffuser through the slurry inlet 14 and accelerated up the slurry pipe by the high velocity jet. In the extendable/erectable arm borehole mining system of this invention, the jet pump can be located either above the tensioning frame 22 or below the lifting cylinder 26. In either position, the slurry inlet 14 is located near the bottom of the mining tool 12 and the slurry passes through the semicircular space 54 (see FIG. 4B) on either side of the launching mechanism 25. The high pressure water required to power the jet pump is provided through a separate conductor in the mining tool 12 and standard sections 10 from a surface high pressure water pumping system.

Figure 2C:
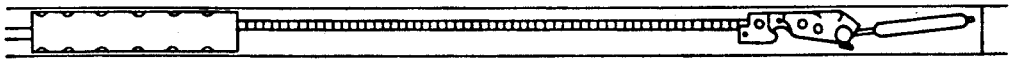
FIGS. 2A, 2B and 2C are cut-away sectional view of a mining tool which incorporates an extendable arm assembly of the present invention, shown at various angles and extensions.
Figure 2B:
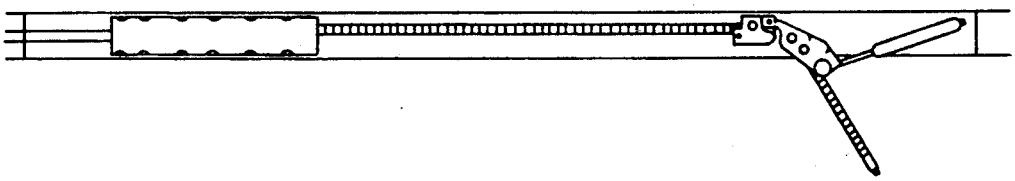
Figure 2A:
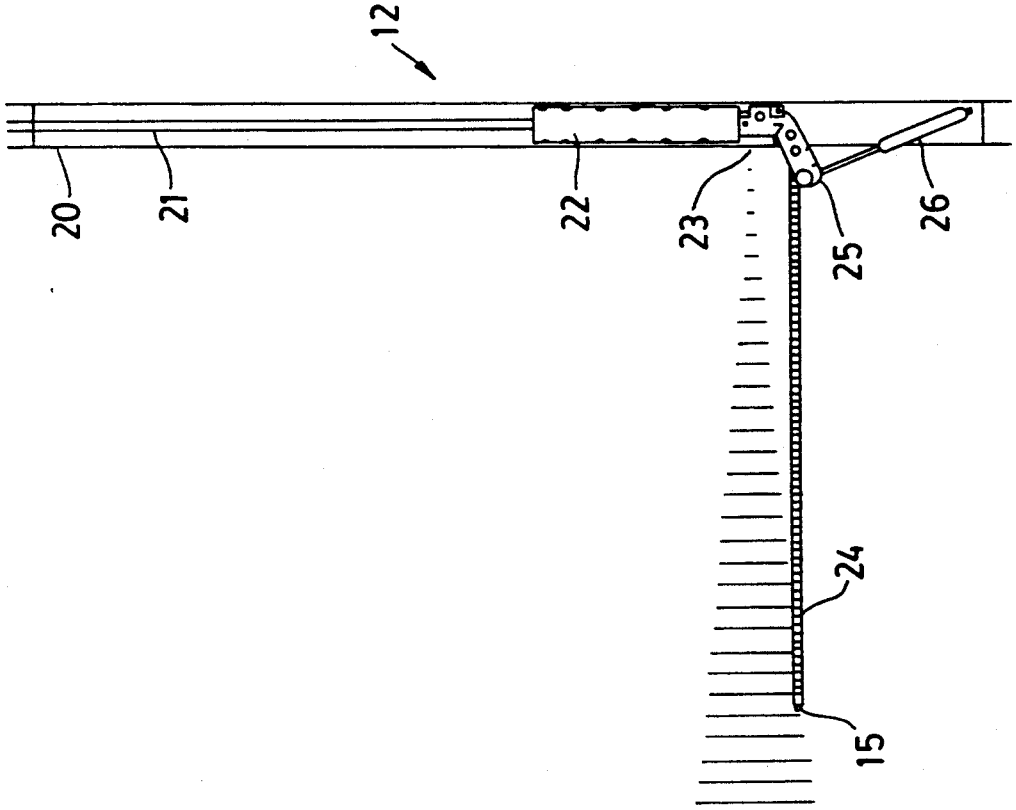

Referring now to FIGS. 2A, 2B and 2C, a mining tool is illustrated generally at 12 in various positions ranging from that in which it is fully stowed and retracted (see FIG. 2C), to that in which it is partially retracted and partially lowered (see FIG. 2B) and finally to that where an extendable arm 24 of the tool 12 is fully extended and raised (see FIG. 2A). Arm 24 is a semi-flexible, extendable and erectable arm which supports the water jet nozzle 15 and a high pressure hose connected to the nozzle at one end and high pressure supply pipe 21 on the other end at some distance away from the mining tool housing 20. Arm 24 (fully illustrated in FIG. 3) can be extended or retracted and raised or lowered remotely by an operator on the mining rig (not illustrated). A description of this remote operation will follow. The distance from the mining tool 12 to the cavity wall (refer to FIG. 1) is measured by a cavity size sensing system 23 (not illustrated) which is located in the mining tool 12. The operator on the surface uses this distance information to determine the correct extension and angle for arm 24. The sensing system may consist of either a ground penetrating radar or low frequency sonar transducer located within the mining tool. Suitable examples of the radar and sonar transducer would be those which are commercially available for this purpose.

In FIG. 2A, there can be seen launching mechanism 25 (details in FIGS. 4, 4A, 4B) and the associated lifting cylinder 26 which lift extendable/erectable arm 24 (details in FIGS. 3, 3A, 3B and 3C) from its fully retracted and stowed vertical position to its fully extended and raised or horizontal mining position. Attached to the launching mechanism 25 and arm 24 is a tensioning frame 22, the details of which will be described subsequently (see FIG. 5). As will be appreciated, tensioning frame 22 is attached to the inboard or upper end of the arm, above the launching mechanism. A high pressure cutting jet supply pipe 21 extends above the tensioning frame 22 and it is with the raising and lowering of this jet supply pipe 21, that the arm assembly 24 may be retracted and extended (respectively) from within the mining tool housing 20.

Figure 3A:
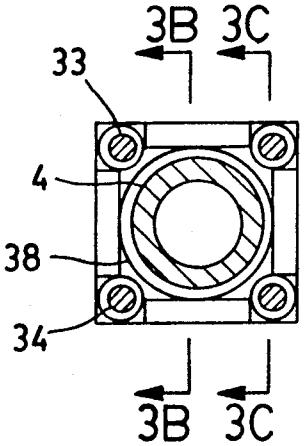
FIG. 3A is a cross-section along line A—A in FIG. 3.
Figure 3B:
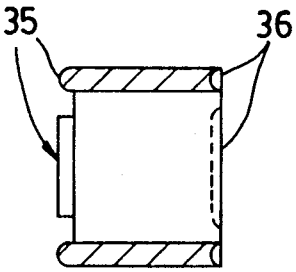
FIGS. 3B and 3C are cross-sections along lines B—B and C—C in FIG. 3A.
Figure 3C:
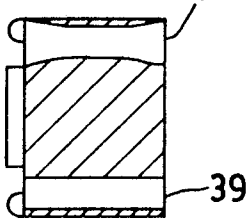
Figure 3:
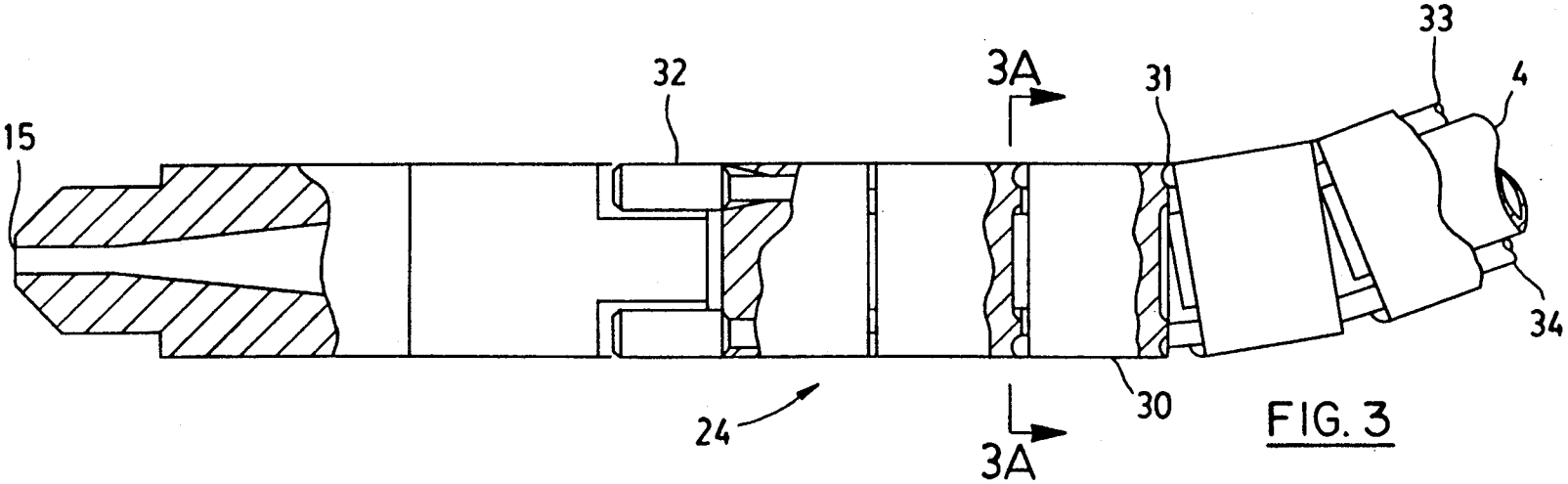
FIG. 3 is a partly cut-away view of the end of the extendable arm assembly of the present invention, illustrating arm segments and a cutting jet nozzle.

FIG. 3 illustrates extendable arm assembly 24 of the invention. Arm 24 is comprised of a plurality of interlocking segments 30 with apertures 37, 39 and 38 which are adapted to receive a pair of upper tensioning cables 33, a pair of lower alignment cables 34 and a high pressure water jet supply hose 4 respectively. Separable hinge joints 31 are provided on the segments comprising hardened male pins 35 and hardened female sockets 36. The male pins 35 at each edge comprise protrusions which are semi-cylindrical in shape while the hardened female sockets 36 are intrusions which are correspondingly shaped and are also of semi-cylindrical shape. This permits the segments 30 to hinge in all vertical and horizontal directions.

In FIGS. 3, 3A, 3B and 3C, a portion of the extendable arm 24 and a typical water jet nozzle 15 are illustrated in detail. The mating pins 35 and sockets 36 on each edge, on the mating faces of each arm segment 30, permits the arm segments to flex easily in all vertical and horizontal directions, since all mating side edges have hinge joints. The upper apertures 37 are of different shape from the lower apertures 39. The upper apertures 37 for tensioning cables 33 are chamferred at each end which permits the segments 30 to bend more easily and prevents abrupt bends in the cables as the articulated arm 24 bends through the 90° angle from vertical to horizontal.

Arm segments 30 are subject to high contact stresses from the cable tension, corrosion from the downhole environment, and abrasion from the ore particles. Unless suitable material is chosen, galling results between the hinge mating surfaces causing rapid wear and excessive friction in the joint 31. Friction interferes with smooth flexing of the arm 24 as it passes through the launching mechanism 25. Thus the male and female pins and sockets 35 and 36 must be made of materials hard enough to carry the contact stresses and resist most abrasives. The protrusions and intrusions 35 and 36 may be plated on the two mating surfaces to get the required surface properties. This plating must be hardened to different values for maximum resistance to galling. Suitable material is hardened martensitic stainless steel plated with electroless nickel and baked to two specific hardness levels which lowers the friction in the joint 31 and provides a hard abrasion and corrosion resistant surface. More expensive surface treatments such as ion implantation or tungsten carbide coatings may be selected also.

In FIG. 3A, which is a cross-section through line A—A of FIG. 3, the arrangement of two upper tensioning cables 33 and two lower alignment cables 34 through apertures 37 and 39, respectively at each corner of the segment 30 may best be seen. Central aperture 38 contains the high pressure water jet supply hose 4 which is the source of pressurized water for the nozzle 15. Nozzle 15 is a typical cutting jet nozzle for this type of mining application. The selection may be the currently preferred Leach and Walker design which produces a long, coherent jet stream at the pressures used for borehole mining. The basic design for such nozzles has been in the public domain for many years.

Cable end fittings 32, swaged onto cables 33 and 34 may be seen in FIG. 3. These are used to secure the cables to the cutting nozzle.

Figures 4, 4A, 4B:
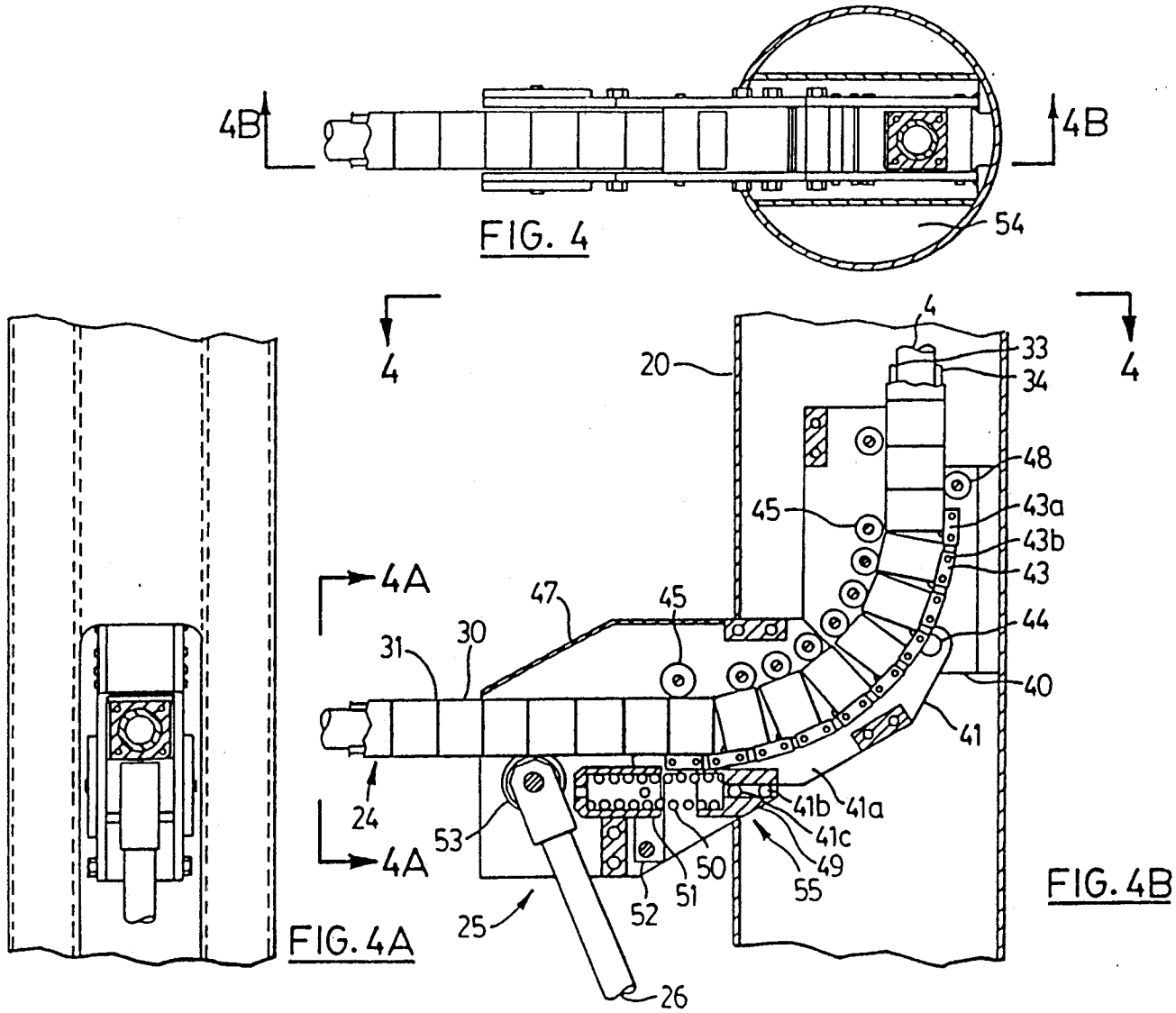
FIG. 4 is a top plan view along line 4—4 in FIG. 4B.
FIG. 4A is a view looking along line A—A in FIG. 4.
FIG. 4B is a partial cross-sectional side view of the extendable arm assembly of the present invention.

The launching mechanism 25 shown generally in FIGS. 2A, 2B and 2C is seen in detail in FIG. 4. The launching mechanism 25 is used to turn arm 24 as it exits the mining tool housing 20. The launching mechanism 25 includes a downwardly angled portion 47 which shields the opening for the arm 24 and deflects debris. A stationary launching frame 40 is mounted within the mining tool housing 20. An elbow pivot point 44 is provided at the lower end of the frame for a launching elbow 41 which pivots about pivot point 44 from a position wherein the articulated arm 24 is generally vertically disposed in its stowed position to a position wherein arm 24 is generally horizontally disposed in its mining position (as seen in this illustration).

An elbow guide chain 43 comprises the lower guide means for the extendable arm 24, while the upper guide means comprises a number of guide rollers 45, nine in number in this embodiment, which reduce friction of the arm as it traverses the launching mechanism 25. The elbow guide chain 43 is required since as the arm 24 passes out of the housing 20 at an angle segments 30 are separated at their under or lower side which provides an irregular surface which could not pass smoothly over rollers. The elbow guide chain 43 preferably consists of hardened side plates 43*a* and pins 43*b*. The elbow guide chain 43 is rigidly fixed at its upper end to the stationary launching frame 40. The lower end of the chain 43 is attached to pivoting links 52 which are part of a chain tensioning mechanism designated generally at 55. Mechanism 55 comprises the pivoting link 52, a spring holder 51, a chain tensioning spring 50 and a chain tension adjusting block 49. The pivoting links 52 are pivotally attached at their lower end to launching elbow 41 and at their upper end to elbow guide chain 43. Chain tensioning spring 50 is stiff and pushes on the chain through the pivoting links 52 through spring holder 51. Chain tension adjusting block 49 permits adjustment chain tensioning of the chain tension by varying the length of spring 50. Chain tension adjusting block 49 is mounted between two elbow side plates 41*a*. Screws 41*b* fit into slots 41*c* in the elbow 41, and attach the chain tension adjusting block 49 to the elbow 41. During assembly of the chain tensioning mechanism 55, a long threaded screw (not shown) is inserted through a clearance hole (not shown) in the adjusting block 49 through the center of the spring 50 and threaded into spring holder 51. The preload on the spring is adjusted by tightening the threaded adjusting screw to pull the spring holder 51 closer to the block 49 to compress the spring 50. When the preload is set to about 200-300 pounds force (set by measuring the spring compressed length) and all the slack is removed from the chain 43 (by sliding the chain tension adjusting block 49 and clamping screws 41*b* along the slots 41*c* in the elbow 41), the clamping screws 44*b* are tightened to fix the position of the chain tension adjusting block 49. The long adjusting screw (see above) is then removed from the assembly 55 since it interferes with the movement of the chain tensioning spring 50 as it holds arm segments 30 tight against the guide rollers 45. The chain tension is set so as to hold the arm segments 30 tight to the guide rollers 45 during extension and retraction, but not so tight as to cause excessive resistance due to friction between the chain and arm segments.

It should be noted that there are lower guide rollers 48 (at the top of the stationary launching frame 40) and at the bottom of the bend path, as part of lifting cylinder 26, namely lower guide roller 53. These are highly stressed areas where arm segments 30 are not open.

The structure of hydraulic lifting cylinder 26 is conventional in nature. The cylinder may be pivotally mounted by a clevis (not shown) on the end of the cylinder 42 to a mounting plate (not shown) inside and at the bottom of the mining tool housing 20 which provides a base support in the borehole.

Figure 5A:
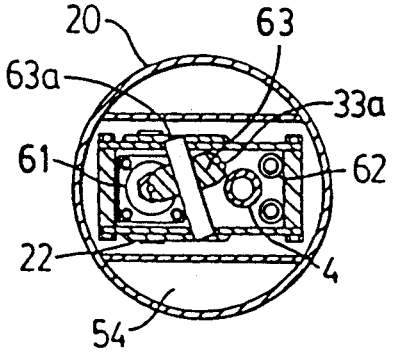
FIG. 5A is a cross-section looking down and taken along line 5A—5A in FIG. 5.
Figure 5B:
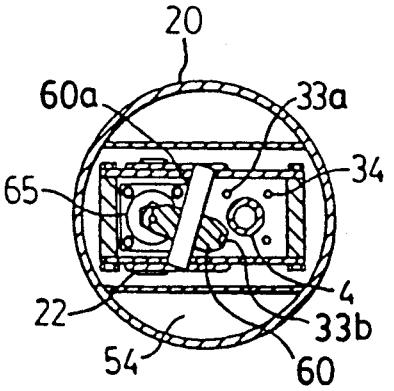
FIG. 5B is a cross-section looking down and taken along line 5B—5B in FIG. 5.
Figure 5:
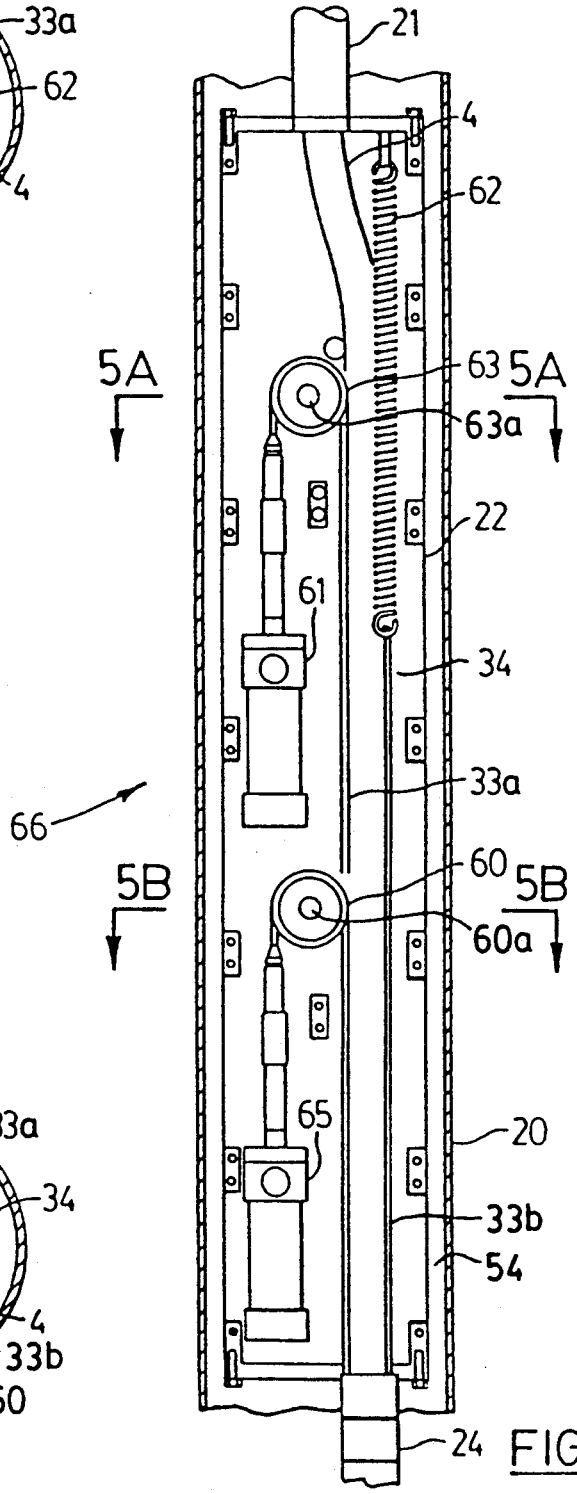
FIG. 5 is a sid view of a mechanism for tensioning the extendable arm assembly.
Figure 6A:
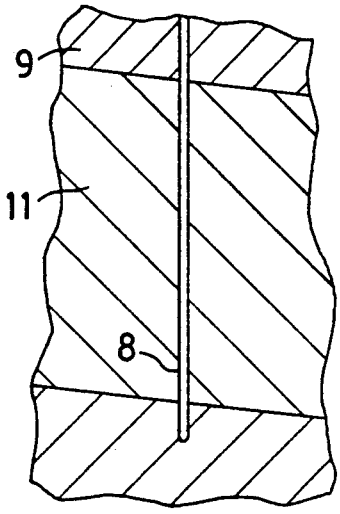
FIGS. 6A to 6F, inclusive, illustrate six steps in the sequence of borehole mining using the articulated arm assembly of this invention.
Figure 6B:
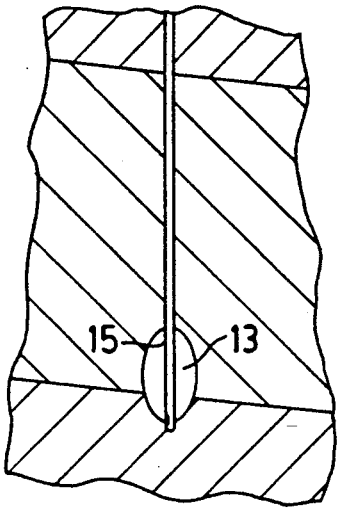
Figure 6C:
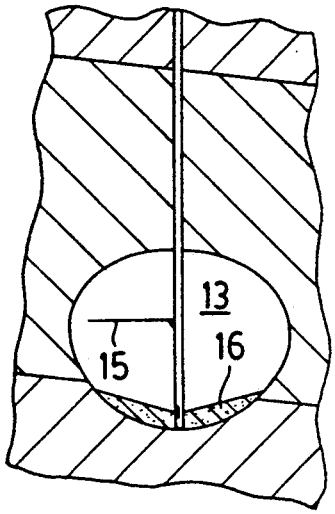
Figure 6D:
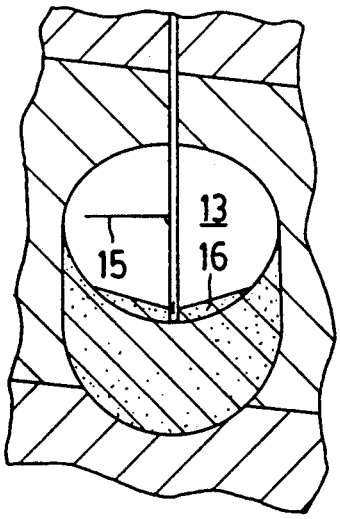
Figure 6E:
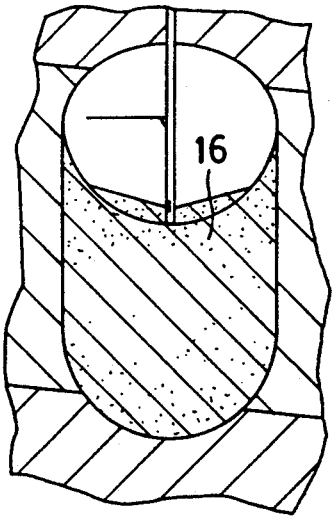
Figure 6F:
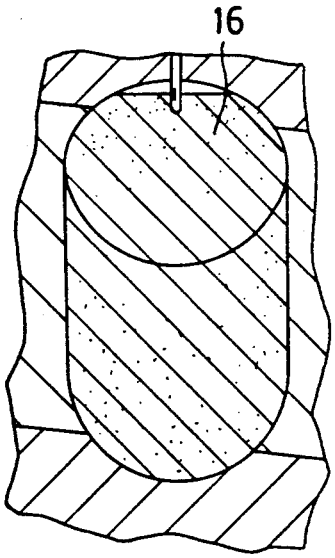

Referring now to FIG. 5, 5A and 5B, there is illustrated in some detail, the cable tensioning mechanism, designated generally at 66 in a borehole 54, which is the erecting means for the extendable arm 24 of the present invention. Cable tensioning mechanism 66 comprises within mining tool housing 20, a tensioning frame 22 to which the extendable/erectable arm 24 is secured at its lower end and a high pressure cutting jet supply pipe 21 is secured to its upper end. Pipe 21 is used to raise and lower tensioning frame 22, usually remotely from the surface, and hence retracts or extends the arm 24.

The tensioning frame 22 contains the means for applying tension to the tension cables 33 and the alignment cables 34 so as to hold arm 24 rigid. The frame 22 is located upward of the arm 24 (as already noted). Inside the frame 22 are two hydraulic tensioning cylinders 61 and 65, for the right and left upper tensioning cables 33*a* and 33*b*, respectively. Cables 33*a* and 33*b* pass over angled sheaves 60 and 63 located on pins 60*a* and 63*a*, respectively to provide compact and convenient locations for the tensioning cylinders 61 and 65. The tension on the upper cables 33*a* and 33*b* holds the arm 24 tight against the bottom of tensioning frame 22. A constant hydraulic fluid pressure is maintained in each of tensioning cylinders 61 and 65 to maintain constant tension on cables 33*a* and 33*b* during operation.

The lower alignment cables 34 are attached to tensioning spring 62 (one for each) which are secured to the top of frame 22 and which maintain a minimal tension on the cables 34 so they can adjust to their changing path length as the launching mechanism 25 is raised and lowered or otherwise deflected when arm 24 is outside of the mining tool 12.

The mining sequence illustrated in FIGS. 6A-6F varies with the type of mineral being mined. In a water filled cavity, water also overflows from the top of the casing.

Depending on the ore being mined, the slurry pumped from the bottom of the cavity or the overflow water may contain the product. Heavier minerals such as coal and uranium are extracted from the bottom slurry. Bitumen, on the other hand, is released from oil sand formations by the action of the water jet and is recovered primarily from the overflow using a water filled cavity. FIGS. 6A to 6F illustrate the mining sequence as it applies to bitumen recovery.

Figure 7:
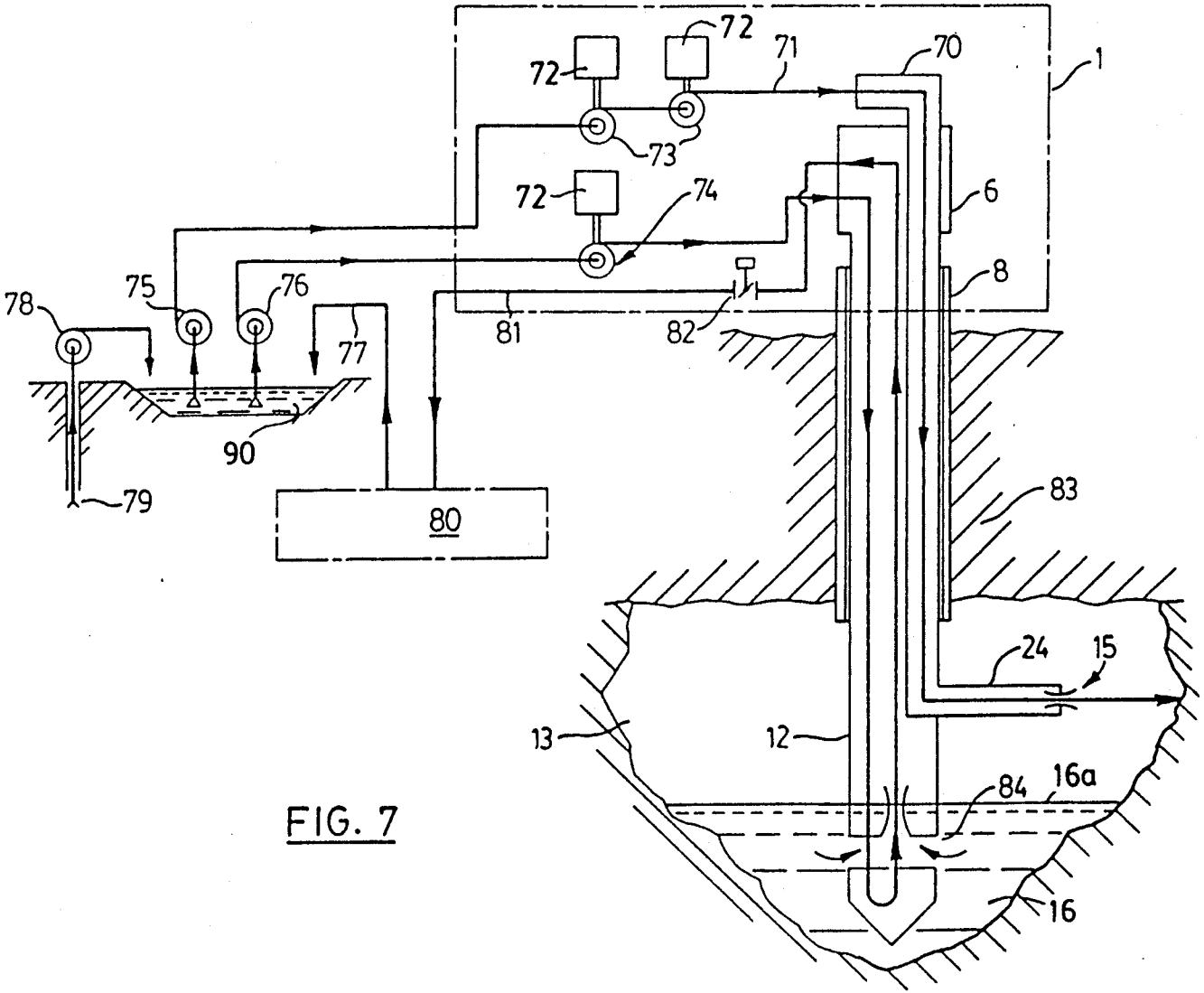
FIG. 7 is a system diagram of a borehole mining assembly in which the present invention may be utilized.

In FIG. 7, there is a flow sheet which shows the flow of fluids in a mining system using the extendable arm assembly of the present invention.

The mining tool 12 which contains the extendable arm 24 is lowered into the borehole casing 8 down to the bottom of the borehole in overburden 83 for mining the ore and thus forming the cavity 13. The pumps 75 and 73 convey pressurized water via the pipe or hose 71, mining tool 12, and the extendable arm 24 to produce a cutting jet through nozzle 15. The whole mining tool assembly is rotated 360 to form a circular cavity 13. Initially, the extendable arm 24 is in a stowed position but is extended slowly to form a progressively larger cavity until a required size is produced. The cavity then is extended vertically starting from the bottom and proceeding towards the top; until the whole cavity is completed.

For the mining operation, two scenarios are possible:

1) cutting in an air filled cavity, or 2) cutting in a water filled cavity

FIG. 7 shows the first alternative where the water level 16a is kept below the cutting jet produced by nozzle 15, but the arm 24 is extended so that the nozzle 15 is only a few feet from the cavity face being cut. To remove the cut material, two scenarios again are possible:

a) remove all the material to the surface where the mineral does not remain in suspension, for example, as in gold mining, or b) remove only 20–40% of the material to make room for expansion of mineral being cut and leave the waste material in the cavity, for example, as in tar sands.

In alternative b), the water level in FIG. 7 is kept at the top of the casing 8 of the borehole so that the extendable arm 24 is kept submerged in water. The hydraulic head provided by the water provides support to the cavity and makes the mining and formation of the cavity possible for some minerals such as tar sands.

The slurry 16 containing the mineral or bitumen in the case of tar sands is pumped via a jet pump 84 from the cavity 13 to surface mineral separation plant 80 via line 81 from which water is recycled via line 77 to a settling pond 90. The make up water to the settling pond 90 is provided from a well 79 or a river via pump 78. The supply to the jet pump 84 is provided from the settling pond 90 via pumps 76 and 74. Each of pumps 73, 74, 75, 76 and 78 have motors not all of which are illustrated. Motors 72 are typical and these may be internal combustion or electric motors. The rotating and stationary components of the mining tool 12 are attached to swivel assemblies, 6 and 70. The whole assembly of the mining tool is contained on a mining rig 1. For better control, a number of sub rigs can be set up, each providing a specific function such as a mining rig, a pump rig, a laboratory, etc., etc.

One borehole mining system can give only a specific amount of production, hence a number of units can give multiple production.

The mining tool can be filled with various known pieces of equipment which can enhance the control aspects of the borehole mining system such as sonar devices to determine the size of the cavity, instruments to locate the nozzle in the extendable arm etc., a backflush valve 82 to flush out any blockages caused by rocks etc. stuck in the jet pump inlet. Backflush valve 82 is provided. Valve 82 can be momentarily closed at the surface as necessary to clear blockages in the jet pump inlet 84. When the backflush 82 is closed, flow through the jet inlet 84 is reversed, flushing-away any accumulation of oversized cuttings which may be blocking the inlet.

The present invention has been described in terms of a specific illustrated embodiment. Many modifications thereof will be apparent to those persons skilled in the related art without departing from the true sprit and scope of my invention.

The embodiments of the invention in which an exclusive property or privilege is claimed are defined as follows:

1. An extendable, retractable, erectable arm assembly for housing and supporting a water conduit which extends outward from a tool locatable in a borehole, to a nozzle to produce a high pressure water cutting jet design for generating a cavity, said arm assembly comprising:

a) a plurality of interlocking arm segments for housing, supporting and moving the conduit through an angle of about 90° from a stowed position to an operating position, said arm segments comprising integral, separable hinges having interlocking means such that pivotal movement is possible along any side thereof, and having mating apertures therethrough to accommodate the conduit;

b) erecting means at an upper portion of the arm segments to provide compression on the segments giving the arm rigidity during movement in any direction;

c) alignment means at a lower portion of the arm segments to keep the arm segments aligned when the arm is deflected;

d) means for applying tension to the erecting means whereby the arm assembly may be held erect in a cantilever position allowing the nozzle to remain in close proximity to a surface at which the high pressure water cutting jet is directed;

e) launching means to turn and lift the arm assembly so that the arm assembly may be extended and retracted at any angle and position; and f) means for moving the arm assembly within the tool from one position to another along the longitudinal axis of the borehole whereby the arm assembly is extended and retracted and hence travels from operating to stowed positions.

2. An arm assembly as claimed in claim 1 wherein the tool is a mining tool located in a substantially vertical borehole, the surface at which the water jet is directed as a mining surface, and the jet may be operated in a water or air filled cavity.

3. An arm assembly as claimed in claim 2 wherein the erecting means comprises at least one tension cable for the extendable arm assembly secured to a tension frame located above the extendable arm assembly when the arm assembly is located in a borehole, hydraulic biasing means associated with the frame for applying tension to the tension cable, and wherein the alignment means comprises at least one spring biased cable secured to the tension frame.

4. An arm assembly as claimed in claim 3 wherein two cables are provided for each of the tensioning and alignment means.

5. An arm assembly as claimed in claim 4 wherein the arm segments are rectangular in transverse cross-section and apertures for the two tension cables are provided at top outer corners of each segment and for the two alignment cables at lower outer corners of each segment.

6. An arm assembly as claimed in claim 5 wherein the interlocking means for the arm segments comprise male and female engagement means.

7. An arm assembly as claimed in claim 6 wherein each arm segment is formed on all edges at one end with male protrusions and at the other end with female intrusions on all edges such that hinge joints may be forced between all sides of adjacent arm segments.

8. An arm assembly as claimed in claim 7 wherein the male protrusions comprise semi-cylindrical shaped pins at each edge and the female intrusions are of corresponding shape to the pins.

9. An arm assembly as claimed in claim 8 wherein the launching means for the arm assembly comprises a stationary frame, a launching elbow pivotably secured to the frame, upper and lower guide means on the frame for the extendable arm assembly, lifting means for the launching elbow for moving the extendable arm assembly from the generally vertical, stowed position to the generally horizontal mining position.

10. An arm assembly as claimed in claim 9 wherein the upper guide means comprises a series of rollers, consecutively arranged along the upper edge of the path of travel for the arm assembly and the lower guide means comprising a tensioned elbow guide chain arranged along the lower edge of the path of travel for the arm assembly, and wherein the tension of the elbow guide chain is preset to hold the extendable arm assembly tight to the rollers of the upper guide means.

11. An arm assembly as claimed in claim 10 wherein the lifting means comprises a hydraulic lift cylinder, one end of said lift cylinder is secured to a base support and the other end of said lift cylinder is secured to the outer end of the launching elbow, said lift cylinder being secured by a securing means which includes a guide ruler for the lower edge of the articulated arm assembly.

12. An arm assembly as claimed in claim 11 further comprising means for remotely operating the arm assembly.

13. An arm assembly as claimed in claim 12, which includes means for sensing the orientation of the arm assembly and the size of a mining cavity.

14. An arm assembly as claimed in claim 13 wherein the sensing means is located within the water cutting jet nozzle.

15. An apparatus for borehole mining comprising:

a) a mining rig for location on a surface at a collar of a borehole drilled for mining purposes, said mining rig incorporates a mining tool, a pressurized water source for a mining tool, and means for rotating a mining tool about its central axis;

b) a mining tool comprising an extendable, retractable, erectable arm assembly for housing and supporting a water conduit which extends outward from a tool locatable in a borehole, to a water cutting jet nozzle to produce a high pressure jet of water designed to generate a mining cavity, said arm assembly comprising:

i) a plurality of interlocking arm segments for housing, supporting and moving the conduit through an angle of about 90° from a stowed position to an operating position, said arm segments comprising integral, separable hinges having interlocking means such that pivotal movement is possible along any side thereof, and having mating apertures therethrough to accommodate the conduit, ii) erecting means at an upper portion of the arm segments to provide compression on the segments giving the arm assembly rigidity during movement in any direction, iii) alignment means at a lower portion of the arm segments to keep the arm segments aligned when the arm assembly is deflected, iv) means for applying tension to the erecting means whereby the arm assembly may be held erect in a cantilever position allowing the water cutting jet nozzle to remain in close proximity to a surface at which the high pressure water jet is directed, v) launching means to turn and lift the arm assembly so that the arm assembly may be extended and retracted at any angle and position, and vi) means for moving the arm assembly within the tool from one position to another along the longitudinal axis of the borehole whereby the arm assembly is extended and retracted and hence travels from operating to stowed positions;

c) a slurry pump associated with the mining tool for pumping mined slurry to the surface;

d) remote operating means at the surface for the mining tool for rotating the tool, applying tension to the arm assembly, retracting, extending and erecting the arm, and mining the ore;

e) cavity sensing and transmitting means located in the mining tool for sensing the size and shape of the mining cavity and transmitting the sensed information; and, when required, f) water supply means for flooding the mining cavity with water whereby the water cutting jet nozzle operates submerged under water.

16. An apparatus as claimed in claim 15 wherein the erecting means comprises at least one tension cable for the extendable arm assembly secured to a tension frame located above the extendable arm assembly when the arm assembly is located in a borehole, hydraulic biasing means associated with the frame for applying tension to the tension cable, and wherein the alignment means comprises at least one spring biased tension cable secured to the tension frame.

17. An apparatus as claimed in claim 16 wherein two cables are provided for each of the tensioning and alignment means.

18. An apparatus as claimed in claim 17 wherein the arm segments are rectangular in transverse cross-section and apertures for the two tension cables re provided at top outer corners of each segment and for the two alignment cables at lower outer corners of each segment.

19. An apparatus as claimed in claim 18 wherein the interlocking means for the arm segments comprise male and female engagement means.

20. An apparatus as claimed in claim 19 wherein each arm segment is formed on all edges at one end with male protrusions and at the other end with female intrusions on all edges such that hinge joints may be formed between all sides of adjacent arm segments.

21. An apparatus as claimed in claim 20 wherein the male protrusions comprise semi-cylindrical shaped pins at each edge and the female intrusions are of corresponding shape to the pins.

22. An apparatus as claimed in claim 21 wherein the launching means for the arm assembly comprises a stationary frame, a launching elbow pivotably secured to the frame, upper and lower guide means on the frame for the extendable arm assembly, lifting means for the launching elbow for moving the extendable arm assembly from the generally vertical, stowed position to the generally horizontal, mining position.

23. An apparatus as claimed in claim 22 wherein the upper guide means comprises a series of rollers, consecutively arranged along the upper edge of the path of travel for the arm assembly and the lower guide means comprises a tensioned elbow guide chain arranged along the lower edge of the path of travel for the arm assembly and wherein the tension of the elbow guide chain is preset to hold the extendable arm assembly tight to the rollers of the upper guide means.

24. An apparatus as claimed in claim 23 wherein the lifting means comprises a hydraulic lifting cylinder, one end of said lift cylinder is secured to a base of a housing for the mining tool and the other end of said lift cylinder is secured to the outer end of the launching elbow, said lift cylinder being secured by a securing means which includes a guide roller for the lower edge of the articulated arm.

25. An apparatus as claimed in claim 24 wherein the sensing means is located within the water cutting jet nozzle.

26. An apparatus as claimed in claim 25 for use in mining of tar sands.

27. An apparatus as claimed in claim 26 for use in mining of coal, lignite, uranium, gold, phosphate, kaolin or any other minerals found in soft rock formations.

28. A method of borehole mining subterranean ore deposits which comprises the following steps:

a) placing a mining rig on a surface at a collar of a borehole drilled for mining purposes, said rig includes a mining tool including a water cutting jet nozzle, a pressurized water source for a mining tool and means for rotating a mining tool about its central axis;

b) inserting the mining tool and a slurry pump from the mining rig into the borehole and lowering the mining tool to the top of an ore zone located in the borehole;

c) reducing ore contained in the ore zone to a slurry by the cutting action of a high pressure jet of water emitted from said mine tool's water cutting jet nozzle, said water cutting jet nozzle being directed at the side of the borehole;

d) supporting the mining tool water cutting jet nozzle for semi-flexible movement in all horizontal and vertical directions as it extends and retracts and bends from, to, and through a generally vertical, stowed position to a generally horizontal, mining position by employing an extendable, retractable, erectable arm assembly, said arm assembly comprises a plurality of interlocking arm segments having integral, separable hinges with interlocking means, said arm segments supplying sufficient rigidity to support the water cutting jet nozzle to insure that the cutting action continues and that the water cutting jet nozzle remains in close proximity with the ore's retreating surface;

e) forming a mining cavity by rotating the water cutting jet nozzle about the mining tool's axis and raining and lowering the water cutting jet nozzle's position relative to the ore's surface, said water cutting jet nozzle being rotated, raised and lowered by a launching means designed to turn and lift the arm assembly;

f) remotely controlling, sensing and positioning the water cutting jet nozzle for mining action;

g) removing from the mining cavity water expelled from the water cutting jet nozzle such that the water cutting jet nozzle operates in air; and h) removing the slurry from the mining cavity.

29. A method as claimed in claim 28 wherein the slurry pump runs at a faster rate than the rate of water supplied to the water cutting jet nozzle.

30. A method of borehole mining subterranean ore deposits which comprises the following steps:

a) placing a mining rig on a surface at a collar of a borehole drilled for mining purposes, said rig includes a mining tool comprising a water cutting jet nozzle, a pressurized water source for a mining tool and means for rotating a mining tool about its central axis;

b) inserting the mining tool and a slurry pump from the mining rig into the borehole and lowering the mining tool to the top of an ore zone located in the borehole;

c) reducing ore contained in the ore zone to a slurry by the cutting action of a high pressure jet of water emitted from said mining tool's water cutting jet nozzle, said water cutting jet nozzle being directed at the side of the borehole;

d) supporting the mining tool water cutting jet nozzle for semi-flexible movement in all horizontal and vertical directions as it extends and retracts and bends from, to, and through a generally vertical, stowed position to a generally horizontal, mining position by employing an extendable, retractable, erectable arm assembly, wherein said arm assembly comprises a plurality of interlocking arm segments having integral, separable hinges with interlocking means, said arm segments supplying sufficient rigidity to support the water cutting jet nozzle to insure that the cutting action continues and that the water cutting jet nozzle remains in close proximity with the ore's retreating surface;

e) forming a mining cavity by rotating the water cutting jet nozzle about the ming tool's axis, and raising and lowering the water cutting jet nozzle's position relative to the ore's surface, said water cutting jet nozzle being rotated, raised and lowered by a launching means designed to turn and lift the arm assembly;

f) remotely controlling, sensing and positioning the water cutting jet nozzle for mining action;

g) permitting water expelled from the water cutting jet nozzle to remain in the mining cavity such that the water cutting jet nozzle operates while being submerged in water; and h) removing the slurry from the mining cavity.

* * * * *